US008654928B2

(12) United States Patent
Steinlage et al.

(10) Patent No.: US 8,654,928 B2
(45) Date of Patent: Feb. 18, 2014

(54) X-RAY TUBE TARGET BRAZED EMISSION LAYER

(75) Inventors: Gregory Alan Steinlage, Hartland, WI (US); Michael Scott Hebert, Franklin, WI (US)

(73) Assignee: General Electric Company, Schenectady, NY (US)

( * ) Notice: Subject to any disclaimer, the term of this patent is extended or adjusted under 35 U.S.C. 154(b) by 191 days.

(21) Appl. No.: 13/353,540

(22) Filed: Jan. 19, 2012

(65) Prior Publication Data

US 2012/0114105 A1 May 10, 2012

Related U.S. Application Data

(63) Continuation of application No. 11/737,932, filed on Apr. 20, 2007, now Pat. No. 8,116,432.

(51) Int. Cl.
*H01J 35/10* (2006.01)
*H01J 35/08* (2006.01)

(52) U.S. Cl.
USPC ..... 378/144; 378/143

(58) Field of Classification Search
USPC ..... 378/125–133, 141, 143, 144
See application file for complete search history.

(56) References Cited

U.S. PATENT DOCUMENTS

| | | | | |
|---|---|---|---|---|
| 2,387,903 | A | | 10/1945 | Hensel |
| 2,933,594 | A | | 4/1960 | Johnson et al. |
| 3,842,305 | A | | 10/1974 | Braun |
| 3,903,585 | A | | 9/1975 | Kosteruk et al. |
| 4,052,640 | A | * | 10/1977 | Hueschen et al. ..... 378/144 |
| 4,132,917 | A | | 1/1979 | Bildstein et al. |
| 4,168,449 | A | | 9/1979 | Koizumi et al. |
| 4,225,789 | A | | 9/1980 | Albrecht |
| 4,331,902 | A | | 5/1982 | Magendans et al. |
| 4,574,388 | A | | 3/1986 | Port et al. |
| 4,597,095 | A | | 6/1986 | Akpan |
| 4,645,121 | A | | 2/1987 | Devine, Jr. |
| 4,689,810 | A | | 8/1987 | Devine, Jr. |
| 4,777,643 | A | | 10/1988 | Devine, Jr. |
| 4,799,250 | A | | 1/1989 | Penato et al. |

(Continued)

FOREIGN PATENT DOCUMENTS

| | | |
|---|---|---|
| DE | 947998 C1 | 8/1956 |
| DE | 7112589 U | 8/1972 |
| DE | 2755746 A1 | 6/1979 |
| FR | 2592987 A1 | 7/1987 |

OTHER PUBLICATIONS

Lundberg et al., "Brazing Molybdenum and Tungsten for High Temperature Service," Oct. 1, 1978, Journal of Welding, vol. 57, Issue 10, p. 9.

(Continued)

*Primary Examiner* — Anastasia Midkiff
(74) *Attorney, Agent, or Firm* — Ziolkowski Patent Solutions Group, SC

(57) ABSTRACT

A target for generating x-rays includes a target substrate comprising molybdenum and having a beveled surface according to a desired track angle, a track comprising tungsten and configured to generate x-rays from high-energy electrons impinging thereon, wherein the track comprises a brazing surface having an area that is less than an area of the beveled surface of the target substrate, and a braze joint attaching the brazing surface of the track to the beveled surface of the target substrate.

20 Claims, 4 Drawing Sheets

(56) References Cited

U.S. PATENT DOCUMENTS

| | | | | |
|---|---|---|---|---|
| 4,802,196 | A | 1/1989 | Tiearney, Jr. et al. | |
| 4,866,745 | A * | 9/1989 | Akai | 378/9 |
| 4,958,364 | A | 9/1990 | Guerin et al. | |
| 4,978,051 | A | 12/1990 | Tiearney, Jr. et al. | |
| 4,982,893 | A | 1/1991 | Ruckle et al. | |
| 5,008,918 | A | 4/1991 | Lee et al. | |
| 5,155,755 | A | 10/1992 | Penato et al. | |
| 5,159,619 | A | 10/1992 | Benz et al. | |
| 5,247,563 | A | 9/1993 | Block et al. | |
| 5,414,748 | A | 5/1995 | Upadhya | |
| 5,498,187 | A | 3/1996 | Eggleston et al. | |
| 5,809,106 | A | 9/1998 | Kitade et al. | |
| 6,400,800 | B1 | 6/2002 | Warren | |
| 8,116,432 | B2 * | 2/2012 | Steinlage et al. | 378/144 |
| 2002/0085678 | A1 | 7/2002 | Warren | |
| 2002/0168051 | A1 | 11/2002 | Lee et al. | |
| 2007/0041505 | A1 | 2/2007 | Hoffman | |
| 2008/0101541 | A1 | 5/2008 | Steinlage et al. | |
| 2008/0217381 | A1 | 9/2008 | Meyer et al. | |
| 2009/0101238 | A1 | 4/2009 | Jossick et al. | |

OTHER PUBLICATIONS

"Platinum Alloys for Brazing Tungsten," Platinum Metals Review, 1963, vol. 7, No. 2, pp. 56-57.

Charles et al., "Selection and Use of Engineering Materials," Third Edition, 1997, Butterworth-Heinemann, a division of Reed Educational and Professional Publishing, Ltd., Oxford, p. 323, col. 1, Lines 12-17.

* cited by examiner

X-RAY TUBE TARGET BRAZED EMISSION LAYER

CROSS-REFERENCE TO RELATED APPLICATION

The present application is a continuation of and claims priority to U.S. patent application Ser. No. 11/737,932 filed Apr. 20, 2007, the disclosure of which is incorporated herein.

BACKGROUND OF THE INVENTION

The present invention relates generally to x-ray tubes and, more particularly, to a method and apparatus of fabricating a target for x-ray generation.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure for the purpose of distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across a cathode-to-anode vacuum gap and produces x-rays upon impact with the anode. Because of the high temperatures generated when the electron beam strikes the target, it is necessary to rotate the anode assembly at high rotational speed.

Newer generation x-ray tubes have increasing demands for providing higher peak power. Higher peak power, though, results in higher peak temperatures occurring in the target assembly, particularly at the target "track," or the point of impact on the target. Thus, for increased peak power applied, there are life and reliability issues with respect to the target. Such effects may be countered to an extent by, for instance, spinning the target faster. However, doing so has implications to reliability and performance of other components within the x-ray tube. As a result there is greater emphasis in finding materials solutions for improved performance and higher reliability of target structures within an x-ray tube.

Therefore, it would be desirable to have a method and apparatus to improve thermal performance and reliability of an x-ray tube target having an improved target track therein.

BRIEF DESCRIPTION OF THE INVENTION

The present invention provides a method and apparatus for brazing a target track to a target substrate in an x-ray tube.

According to one aspect of the present invention, a target for generating x-rays includes a target substrate comprising at least one layer of a target material, a track comprising at least one layer of a track material, the track configured to generate x-rays from high-energy electrons impinging thereon, and a braze joint attaching the target substrate to the track.

In accordance with another aspect of the invention, a method of fabricating an x-ray target assembly includes forming a substrate having at least one layer of substrate material, and positioning a track proximate the substrate, the track having at least one layer of track material. The method further includes positioning an initial joint material between the substrate and the track, and elevating a temperature of the substrate, the track, and the initial joint material to disperse the initial joint material into at least one of the substrate and the track to form a final joint therebetween.

Yet another aspect of the present invention includes an imaging system having an x-ray detector and an x-ray emission source. The x-ray emission source includes an anode and a cathode. The anode includes a target base material, a track material, and a braze joint positioned between the target base material and the track material.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the present invention is described with respect to the use of an x-ray tube as used in a computed tomography (CT) system such as, for instance, a sixty-four slice CT system. The present invention will be described with respect to a "third generation" CT medical imaging scanner, but is equally applicable with other CT systems, such as a baggage scanner. However, it will be appreciated by those skilled in the art that the present invention is equally applicable for use in other systems that require the use of an x-ray tube. Such uses include, but are not limited to, x-ray imaging systems (for medical and non-medical use), mammography imaging systems, and RAD systems.

Moreover, the present invention will be described with respect to use in an x-ray tube. However, one skilled in the art will further appreciate that the present invention is equally applicable for other systems that require operation of a target used for the production of x-rays wherein high peak temperatures are driven by peak power requirements.

Figure 1:
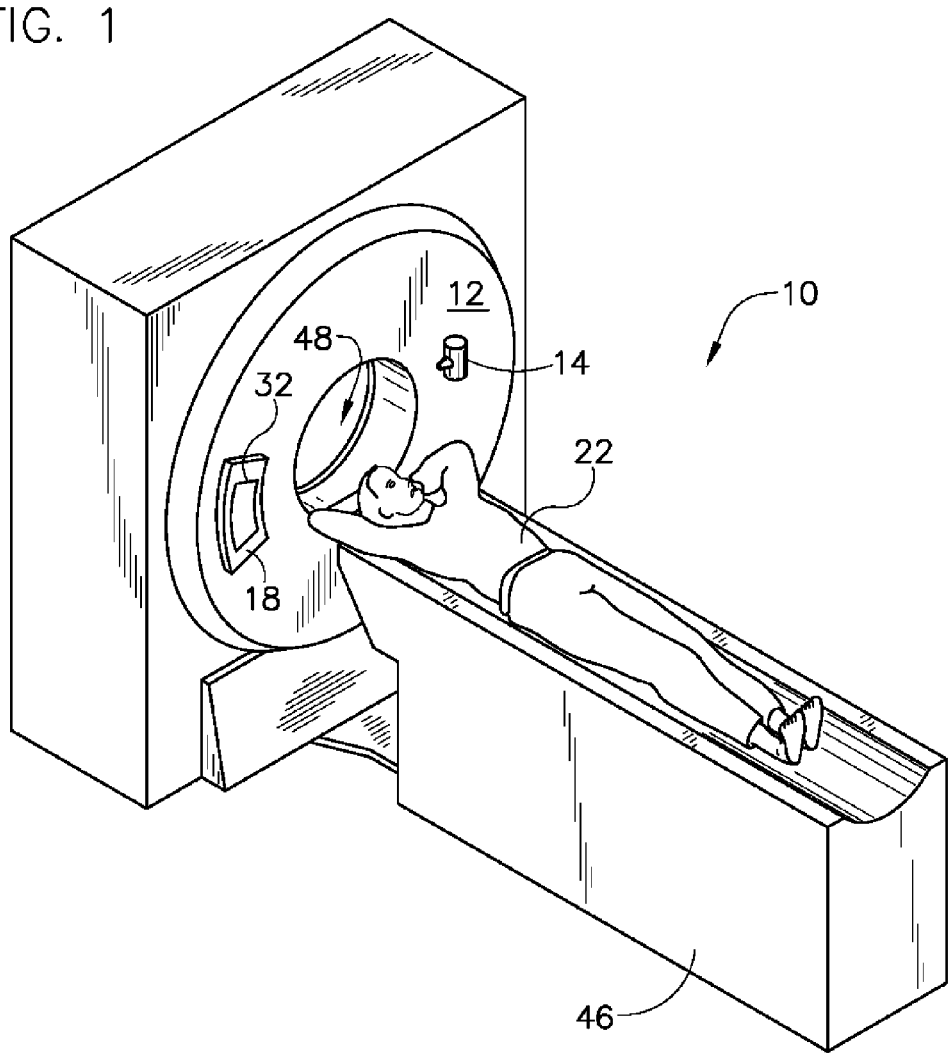
FIG. 1 is a pictorial view of a CT imaging system that can benefit from incorporation of an embodiment of the present invention.
Figure 2:
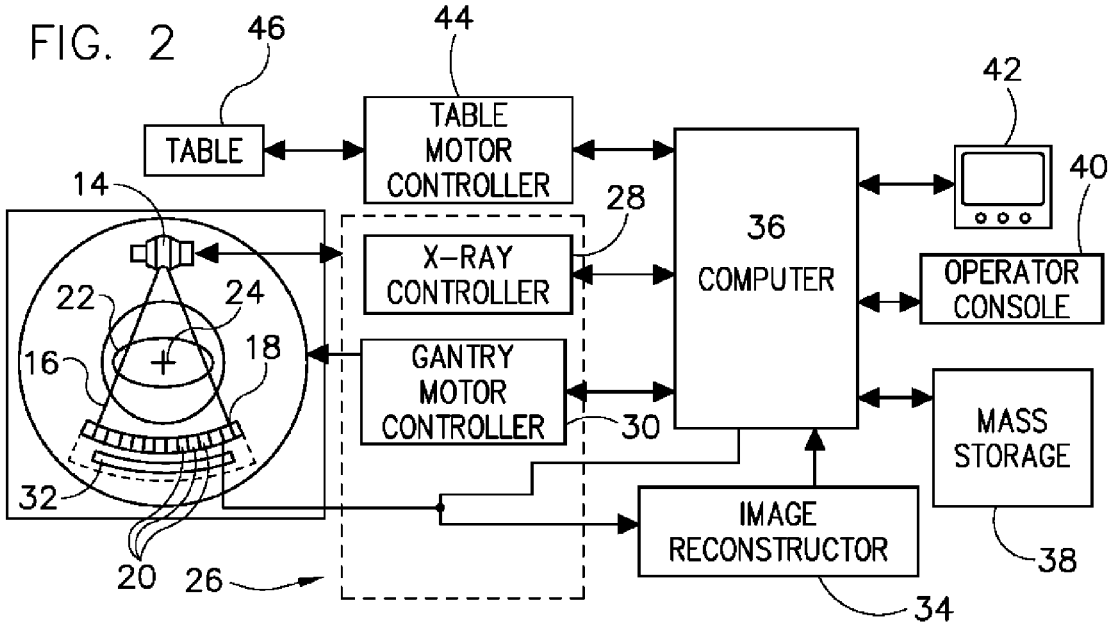
FIG. 2 is a block schematic diagram of the system illustrated in FIG. 1.

Referring to FIG. 1, a computed tomography (CT) imaging system 10 is shown as including a gantry 12 representative of a "third generation" CT scanner. Gantry 12 has an x-ray source 14 that projects a beam of x-rays 16 toward a detector assembly 18 or collimator on the opposite side of the gantry 12. Referring now to FIG. 2, detector assembly 18 is formed by a plurality of detectors 20 and data acquisition system (DAS) 32. The plurality of detectors 20 sense the projected x-rays that pass through a medical patient 22, and DAS 32 converts the data to digital signals for subsequent processing. Each detector 20 produces an analog electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to an x-ray source 14 and a gantry motor controller 30 that controls the rotational speed and position of gantry 12. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves patients 22 through a gantry opening 48 of FIG. 1 in whole or in part.

Figure 3:
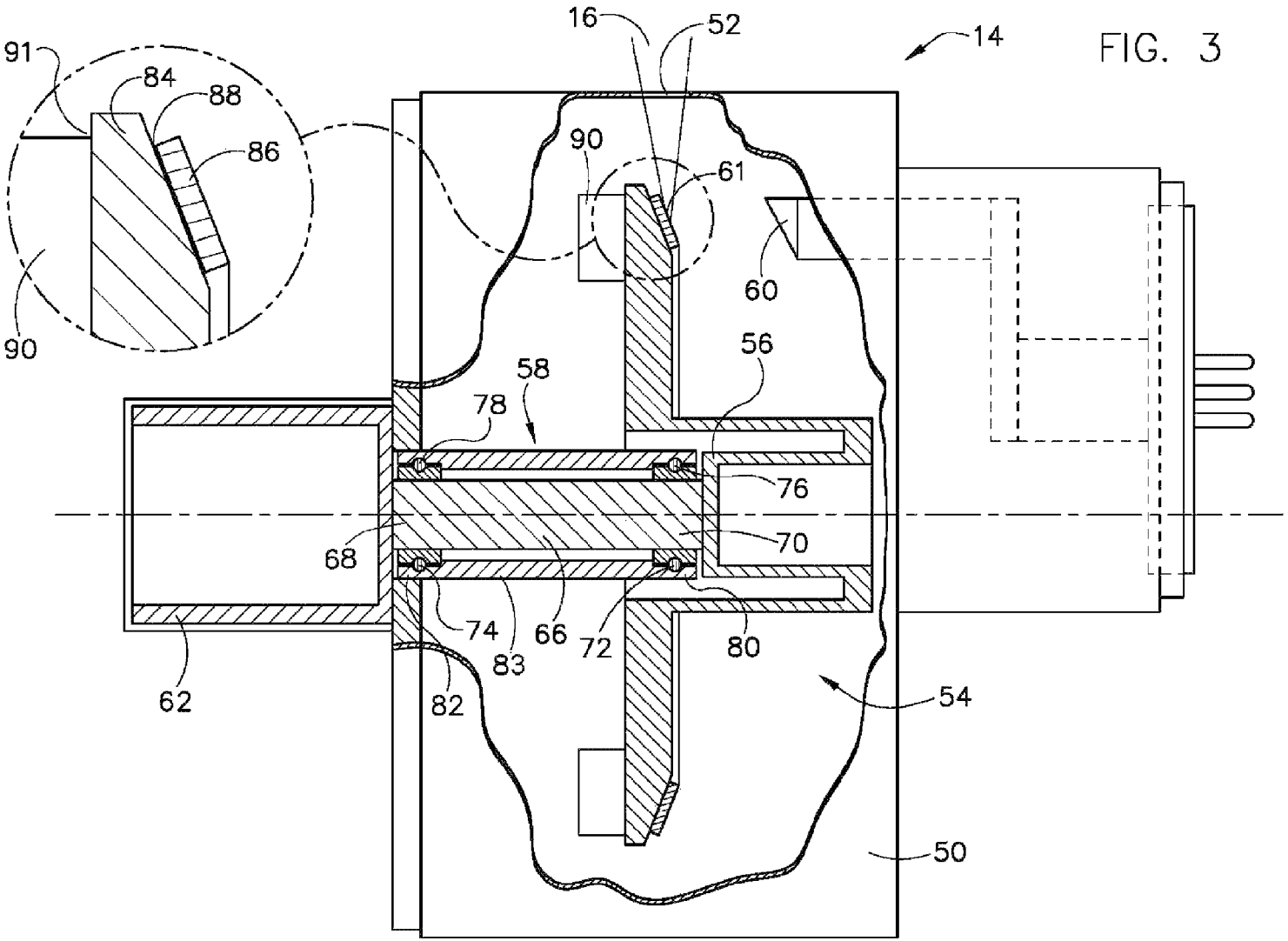
FIG. 3 is a cross-sectional view of an x-ray tube useable with the system illustrated in FIG. 1 according to an embodiment of the present invention.

FIG. 3 illustrates a cross-sectional view of an x-ray tube 14 that can benefit from incorporation of an embodiment of the present invention. The x-ray tube 14 includes a casing 50 having a radiation emission passage 52 formed therein. The casing 50 encloses a vacuum 54 and houses an anode 56, a bearing assembly 58, a cathode 60, and a rotor 62. X-rays 16 are produced when high-speed electrons are suddenly decelerated when directed from the cathode 60 to the anode 56 via a potential difference therebetween of, for example, 60 thousand volts or more in the case of CT applications. The electrons impact a material layer 86 at focal point 61 and x-rays 16 emit therefrom. The point of impact is typically referred to in the industry as the track, which forms a circular region on the surface of the material layer 86, and is visually evident on the target surface after operation of the x-ray tube 14. The x-rays 16 emit through the radiation emission passage 52 toward a detector array, such as detector array 18 of FIG. 2. To avoid overheating the anode 56 from the electrons, the anode 56 is rotated at a high rate of speed about a centerline 64 at, for example, 90-250 Hz.

The bearing assembly 58 includes a center shaft 66 attached to the rotor 62 at first end 68 and attached to the anode 56 at second end 70. A front inner race 72 and a rear inner race 74 rollingly engage a plurality of front balls 76 and a plurality of rear balls 78, respectively. Bearing assembly 58 also includes a front outer race 80 and a rear outer race 82 configured to rollingly engage and position, respectively, the plurality of front balls 76 and the plurality of rear balls 78. Bearing assembly 58 includes a stem 83 which is supported by the x-ray tube 14. A stator (not shown) is positioned radially external to and drives the rotor 62, which rotationally drives anode 56.

Figure 4:
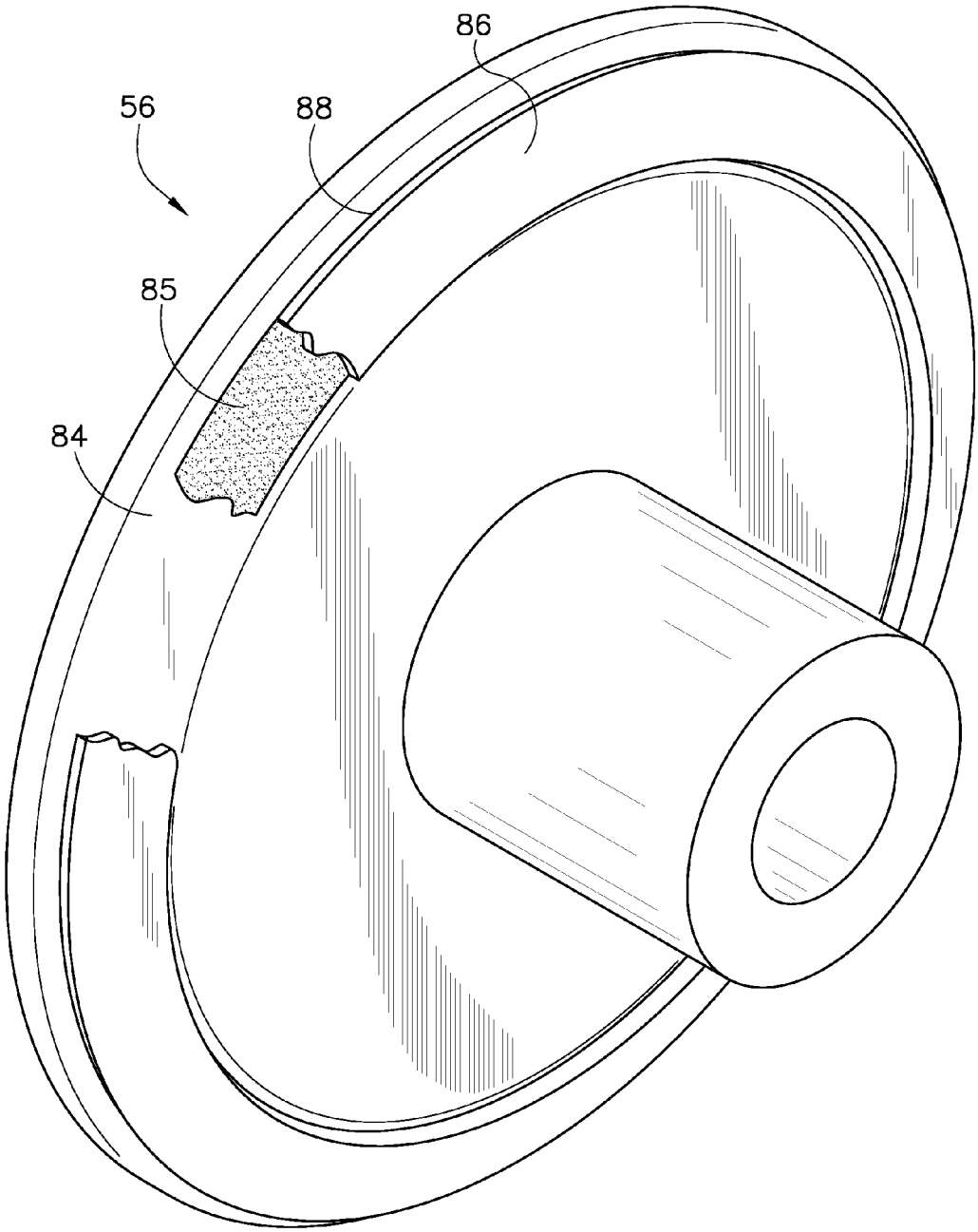
FIG. 4 is a perspective view of an anode of an x-ray tube according to an embodiment of the present invention.

Referring to FIGS. 3 and 4, the anode 56 includes a target substrate 84, having material layer 86 attached thereto according to an embodiment of the present invention. The material layer 86 typically includes tungsten or an alloy of tungsten, and the target substrate 84 typically includes molybdenum or an alloy of molybdenum. Furthermore, one or both alloys may be in wrought form in an embodiment of this invention. A braze joint 88, attaches the material layer 86 to the target substrate 84. The braze joint 88 is formed using an initial braze or joint material 85 such as a braze foil, a braze paste, or a braze coating. The initial braze material 85, in one embodiment, includes zirconium, titanium, vanadium, platinum, or the like.

The initial braze material 85 is positioned between the target substrate 84 and the material layer 86 by either positioning it separately therebetween or by attaching it to one or both of the target substrate 84 and material layer 86 prior to elevating the temperature thereof in the braze process. In one embodiment, the track substrate 84 is beveled according to a desired track angle. Braze joint 88 is formed in anode 56 in one embodiment by positioning initial braze material 85 between track substrate 84 and material layer 86. Once the initial braze material 85 is positioned, the material layer 86 is pressurized or otherwise pressed against the target substrate 84 to, for instance, 15 KSI, 30 KSI, or higher. While under pressure, the temperature of the anode 56, including the target substrate 84, initial braze material 85, and material layer 86, is raised to or above a braze diffusion temperature of the initial braze material 85 but below a melt temperature of the initial braze material 85. In this manner, both the pressure and the heat allow the initial braze material 85 to interdiffuse with the target substrate 84 and the material layer 86 and form a bond therebetween. Accordingly, the final braze joint 88 is formed without raising the temperature above the melt temperature of the initial braze material. As an example, the anode 56 temperature may be raised to, for instance, 1500° C. and held at such temperature during the formation of the braze joint 88. By so doing, the initial braze material 85 (i.e., titanium in one embodiment having a melt temperature of, for instance, 1670° C.) will interdiffuse with the target substrate 84 and the material layer 86, thus forming braze joint 88. Braze joint 88 formed as such has a melt temperature much higher than the melt temperature of the initial braze material 85. During formation of the bond, material of the target substrate 84 and material of the material layer 86 enters the rich band of initial braze material 85, and concentration of the initial braze material 85 will diminish as the bond forms and as the initial braze material 85 diffuses with the target substrate 84 and the material layer 86.

Still referring to FIGS. 3 and 4, braze joint 88 may be formed according to another embodiment of the present invention by heating the anode 56, including the target substrate 84, initial braze material 85, and material layer 86, above the melt temperature of the initial braze material 85. As an example, for an initial braze material 85 having a melt temperature of 1670° C., the anode 56 may be raised thereabove, and held at such temperature during the formation of the braze joint 88. An advantage of raising the anode 56 above the melt temperature is that high pressure may not be necessary in order to form the bond and braze joint 88.

As shown in FIG. 3, a heat storage medium 90, such as graphite, may be used to sink and/or dissipate heat built-up near the target track 63. In one embodiment, heat storage medium 90 is brazed to the anode 56 simultaneously with formation of the braze joint 88. That is, assembly of the anode 56 may include brazing the material layer 86 to the target substrate 84 while simultaneously forming a braze joint 91 between the heat storage medium 90 and target substrate 84. Heat storage medium 90 may be brazed to anode 56 in a manner as described above. That is, braze joint 91 may be formed by using a braze material that, likewise, forms braze joint 91 by raising the temperature of the assembly below a melt temperature of the initial braze material therein. Alternatively, braze joint 91 may be formed by using a braze material having a melt temperature below that to which the temperature of the assembly is raised.

In another embodiment, heat storage medium 90 may be attached to target substrate 84 independent of formation of the braze joint 88. In this manner, braze joint 91 may be formed via a brazing process as described above, or heat storage medium 90 may be attached to target substrate 84 via another known process.

Accordingly, formation of a braze joint 88 using, in one embodiment, titanium having an initial melt temperature of 1670° C. to form the braze joint 88 between the target substrate 84, such as tungsten, and a material layer 86, using material such as molybdenum, may result in a melt temperature of the braze joint 88 of 2000° C. Once the tungsten and molybdenum are fully diffused in the titanium rich band, a braze joint 88 may be formed having melt properties which well exceed that of the initial braze material 85.

Figure 5:
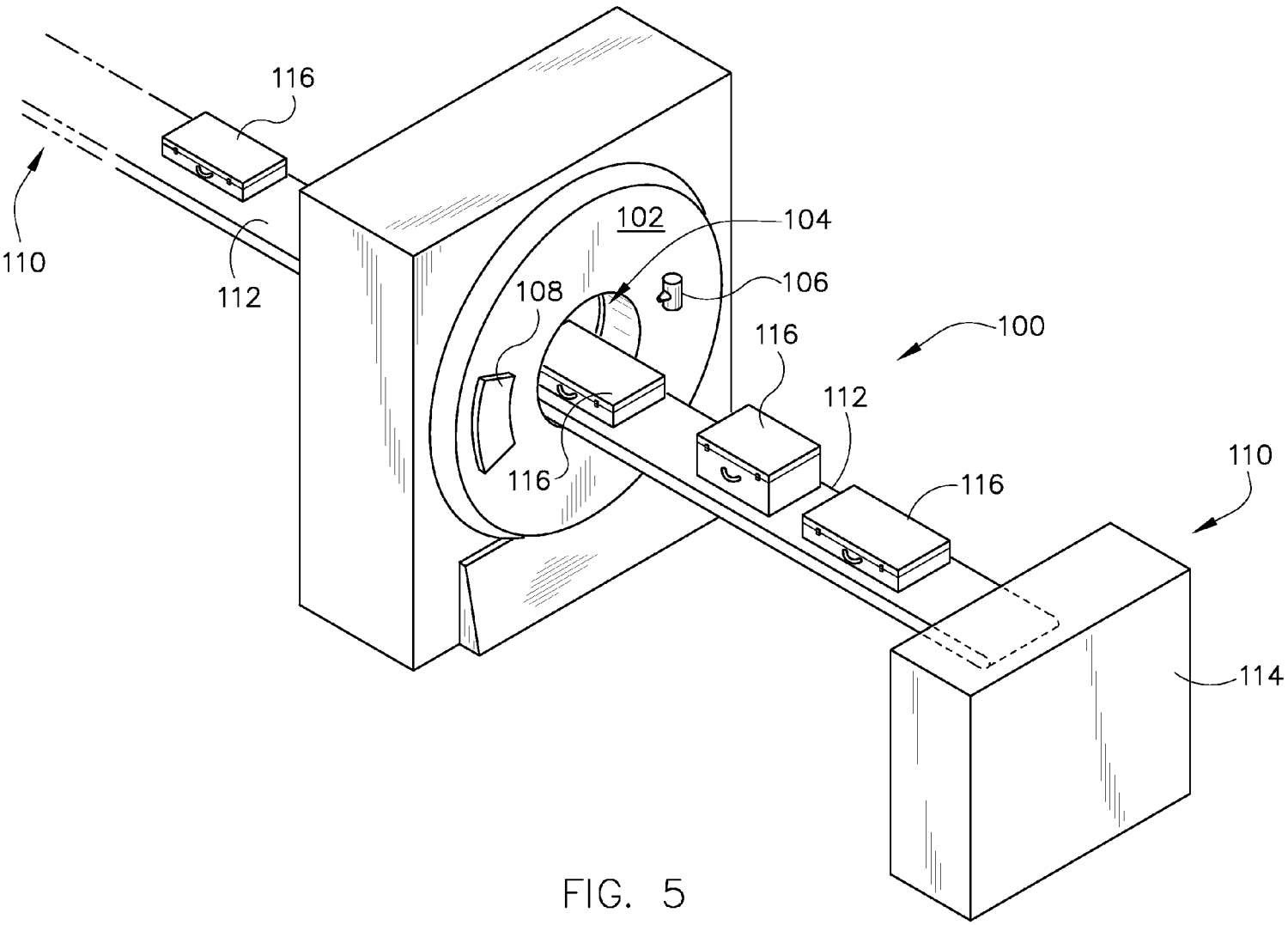
FIG. 5 is a pictorial view of a CT system for use with a non-invasive package inspection system.

FIG. 5 is a pictorial view of a CT system for use with a non-invasive package inspection system. Package/baggage inspection system 100 includes a rotatable gantry 102 having an opening 104 therein through which packages or pieces of baggage may pass. The rotatable gantry 102 houses a high frequency electromagnetic energy source 106 as well as a detector assembly 108 having scintillator arrays comprised of scintillator cells. A conveyor system 110 is also provided and includes a conveyor belt 112 supported by structure 114 to automatically and continuously pass packages or baggage pieces 116 through opening 104 to be scanned. Objects 116 are fed through opening 104 by conveyor belt 112, imaging data is then acquired, and the conveyor belt 112 removes the packages 116 from opening 104 in a controlled and continuous manner. As a result, postal inspectors, baggage handlers, and other security personnel may non-invasively inspect the contents of packages 116 for explosives, knives, guns, contraband, etc.

According to one embodiment of the present invention, a target for generating x-rays includes a target substrate comprising at least one layer of a target material, a track comprising at least one layer of a track material, the track configured to generate x-rays from high-energy electrons impinging thereon, and a braze joint attaching the target substrate to the track.

In accordance with another embodiment of the invention, a method of fabricating an x-ray target assembly includes forming a substrate having at least one layer of substrate material, and positioning a track proximate the substrate, the track having at least one layer of track material. The method further includes positioning an initial joint material between the substrate and the track, and elevating a temperature of the substrate, the track, and the initial joint material to disperse the initial joint material into at least one of the substrate and the track to form a final joint therebetween.

Yet another embodiment of the present invention includes an imaging system having an x-ray detector and an x-ray emission source. The x-ray emission source includes an anode and a cathode. The anode includes a target base material, a track material, and a braze joint positioned between the target base material and the track material.

The present invention has been described in terms of the preferred embodiment, and it is recognized that equivalents, alternatives, and modifications, aside from those expressly stated, are possible and within the scope of the appending claims.

What is claimed is:

1. A target for generating x-rays comprising:

a target substrate comprising molybdenum and having a beveled surface according to a desired track angle;

a track comprising tungsten and configured to generate x-rays from high-energy electrons impinging thereon, wherein the track comprises a brazing surface having an area that is less than an area of the beveled surface of the target substrate; and a braze joint attaching the brazing surface of the track to the beveled surface of the target substrate.

2. The target of claim 1 wherein the braze joint comprises zirconium.

3. The target of claim 1 wherein the braze joint comprises platinum.

4. The target of claim 1 wherein the braze joint comprises titanium.

5. The target of claim 1 wherein the braze joint comprises vanadium.

6. The target of claim 1 wherein the track is in a wrought form and comprises a rectangular cross-section.

7. The target of claim 6 wherein the track protrudes from the beveled surface of the target substrate.

8. A method of fabricating an x-ray target assembly comprising:

forming a target substrate comprised of molybdenum and having a beveled surface area according to a desired track angle;

positioning a tungsten track on the target substrate, the target substrate having a brazing surface area that is less than the beveled surface area of the target substrate;

positioning an initial joint material between the target substrate and the brazing surface area of the tungsten track; and elevating a temperature of the target substrate, the tungsten track, and the initial joint material to disperse the initial joint material into at least one of the target substrate and the tungsten track to form a final joint therebetween.

9. The method of claim 8 comprising brazing graphite to the substrate while elevating the temperature of the target substrate, the tungsten track, and the initial joint material.

10. The method of claim 8 wherein the elevated temperature is below a melt temperature of the initial joint material.

11. The method of claim 8 comprising applying external pressure that exceeds 15 KSI to the target substrate, the tungsten track, and the initial joint material while a temperature thereof is elevated.

12. The method of claim 8 wherein forming the tungsten track comprises forming the tungsten track having a rectangular cross-section prior to positioning the tungsten track on the target substrate.

13. The method of claim 8 wherein positioning the initial joint material comprises positioning one of zirconium and vanadium.

14. The method of claim 8 wherein positioning the initial joint material comprises positioning titanium, and wherein elevating the temperature of the target substrate, the tungsten track, and the initial joint material comprises elevating the temperature to approximately 1500° C.

15. An x-ray tube comprising:

a bearing assembly comprising:

a bearing shaft;

a front bearing assembly;

a rear bearing assembly;

a rotor attached to a first end of the bearing shaft; and a target assembly attached to a second end of the bearing shaft, the target assembly comprising:

a target substrate comprising molybdenum and having a beveled surface according to a desired track angle;

a track comprising tungsten and configured to generate x-rays from high-energy electrons impinging thereon, the track having a brazing surface that is smaller than an area of the beveled surface of the target substrate; and a braze joint attaching the brazing surface of the track to the target substrate.

16. The x-ray tube of claim 15 wherein the braze joint comprises one of platinum and titanium.

17. The x-ray tube of claim 15 wherein the braze joint comprises zirconium.

18. The x-ray tube of claim 15 wherein the braze joint comprises vanadium.

19. The x-ray tube of claim 15 wherein the track is in a wrought form and comprises a rectangular cross-section.

20. The x-ray tube of claim 15 wherein the track protrudes from the beveled surface of the target substrate.

* * * * *